US005718211A

United States Patent [19]

Halsall et al.

[11] Patent Number: 5,718,211

[45] Date of Patent: Feb. 17, 1998

[54] EXHAUST GAS RECIRCULATION VALVE

[75] Inventors: John Anthony Sidney Halsall, Henley-on-Thames; David Michael Snare, Ashford, both of England

[73] Assignee: Shalibane PLC, Camberley, England

[21] Appl. No.: 676,969

[22] Filed: Jul. 8, 1996

[30] Foreign Application Priority Data

Jul. 11, 1995 [GB] United Kingdom ..... 9514086

[51] Int. Cl.[6] ..... F02M 25/07

[52] U.S. Cl. ..... 123/568; 137/907

[58] Field of Search ..... 123/568, 569, 123/570, 571; 137/907

[56] References Cited

U.S. PATENT DOCUMENTS

| | | | |
|---|---|---|---|
| 3,972,312 | 8/1976 | Walker | 123/568 |
| 4,044,737 | 8/1977 | Nishimura | 123/568 |
| 4,106,449 | 8/1978 | Matsumoto et al. | 123/568 |
| 4,106,452 | 8/1978 | Mizutaivi | 123/568 |
| 4,218,040 | 8/1980 | Brakebill | 251/28 |
| 4,285,317 | 8/1981 | Takahara et al. | 123/568 |
| 4,345,572 | 8/1982 | Suzuki et al. | 123/568 |
| 5,351,669 | 10/1994 | Herzog | 123/568 |

FOREIGN PATENT DOCUMENTS

| | | |
|---|---|---|
| 1437319 | 5/1976 | United Kingdom . |
| 1458467 | 12/1976 | United Kingdom . |

*Primary Examiner*—Willis R. Wolfe

*Attorney, Agent, or Firm*—Robert W. J. Usher

[57] ABSTRACT

In an exhaust gas recirculation valve for and internal combustion engine, a valve housing is a short straight length of cylindrical tube (12,62,72), a valve seal (18) comprises a cylindrical bush is an interference fit in the straight housing between the two ends and is fixed in place by crimping, welding or brazing, an actuator (14) is responsive to inlet manifold suction, a valve member (30,32) cooperates with the seat to control the passage of exhaust gases through the valve in response to the actuator. The valve also has a lateral gas outlet aperture (20) in the tube wall on the outlet side of the valve seat and a length of exhaust gas recirculation tubing (24) connected thereto for recirculating gases to the induction side of the engine, and a gas inlet (22) to the housing to the inlet side of the valve seat for receiving engine exhaust gases whose recirculation is to be controlled by the valve. The actuator (14) is mounted over the first end of the housing tube and is connected to the valve member by a rod (32) extending axially down the tube to a valve head (30) which engages a conically tapered axial through passage in the valve seat.

6 Claims, 2 Drawing Sheets

EXHAUST GAS RECIRCULATION VALVE

BACKGROUND OF THE INVENTION

This invention relates to a valve for controlling exhaust gas recirculation (EGR) in an internal combustion engine.

Exhaust gases from internal combustion engines contain unburned fuel and pollutants, in amounts that vary with engine load and condition. It is well known to provide an exhaust gas take off from, for example, the region of the exhaust manifold, with pipework to duct a proportion of the exhaust gases back to the induction side of the engine, there to be mixed with the fresh incoming air and fuel mixture and returned to the combustion chamber. This provides an opportunity for the previously unburned fuel to be used and for the pollutants to be oxidised to a less noxious state.

It is highly desirable to provide a valve for controlling the exhaust gas recirculation flow in an attempt to optimise the proportion of exhaust gas that is being recycled at any time, in accordance with prevailing conditions in the engine. Typically the valve is controlled by an actuator such as a diaphragm that is responsive to the inlet manifold suction, with additional control parameters derived from a variety of electronic transducers monitoring other engine variables. A conventional exhaust gas recirculation valve may comprise a cast metal housing for the valve mechanism. The casting may not offer a sufficiently accurate valve seat without further treatment, which may include the provision of a seat insert which, in turn, may need to be secured in place by further operations.

U.S. Pat. No. 5,351,669 describes an alternative simpler exhaust gas recirculation valve for an internal combustion engine in which the valve seat is formed by a simple constriction in the tubular end section of the exhaust gas feeder pipe itself. An actuator is responsive to inlet manifold suction to control a valve member that cooperates with the outlet side of the seat to control the passage of exhaust gases through the valve to a gas outlet in the tube wall, which is connected to a length of exhaust gas recirculation tubing for recirculating gases to the induction side of the engine.

SUMMARY OF THE INVENTION

In practice, the layout of the engine and its relation to other parts in the engine compartment of a car or other vehicle largely determines the positioning of the EGR pipework, valve and actuator, so that different vehicles require different designs. This invention is concerned with providing a valve that is adaptable to such different layout requirements and economical to manufacture, so that the costs of manufacturing even a large variety of different versions can be kept low, while permitting effective and reliable performance in each case. The durability of the valve when exposed to hot exhaust gases is another important factor to take into account.

According to one aspect of this invention, the valve housing is a straight length of cylindrical tube having a first end and a second end, and the valve seat is an insert that is received within the straight housing between the two ends and is closely engaged with a cylindrical inner wall surface thereof.

In this aspect of the invention, the valve consists essentially of a cylindrical housing that can be made of any suitable rolled and welded or extruded tubing with a lateral aperture formed in it for the attachment of outlet EGR tubing, a valve member, and a valve seat that can be a machined cylindrical bush that is an interference fit in the tube and can be fixed in place, such as by crimping, welding or brazing, according to the materials used. The provision of the lateral gas outlet is a straightforward task, and as compared with known valves which may involve cast housings or deformed tube sections, the manufacture of such a valve can be seen to be relatively simple, while providing a versatile and durable design.

The valve actuator can be mounted over the first end of the housing tube and operatively connected to the valve member, such as by a rod extending axially down the tube to a valve head adapted to engage the valve seat. Either the inlet aperture or, preferably, the outlet aperture, will then lie between the first end of the tube and the valve seat.

The inlet to the housing can be an extension of the tube itself or, preferably, a lateral gas inlet aperture in the tube wall on the inlet side of the valve seat with a length of EGR tubing connected thereto. The second end of the cylindrical housing tube can be blanked off by an end plug or cap, so that the valve comprises, from the second end to the first end of the straight tube, a blanking piece, a lateral inlet, a valve head and valve seat, a lateral outlet, and an actuator closing the first end. This can be a short structure, which is substantially identical for different engine layouts, with only the orientations of the inlet and outlet tubing being changed. Moreover, it can be made light in weight so that the support brackets that are necessary for conventional heavy EGR valves can also be considerably lightened, with savings in manufacturing cost and materials.

The valve can be manufactured by forming a straight cylindrical length of tube, providing a lateral gas outlet aperture in the tube wall adjacent a first end thereof and optionally a lateral gas inlet aperture in the tube wall further from the first end than the outlet aperture, inserting a valve seat into the tube further from the first end than the outlet aperture and, if an inlet aperture is provided, between the outlet aperture and the inlet aperture, and fixing the valve seat in place. The assembly can be completed by the attachment of EGR tubing and blanking off one end, normally the inlet end if required, inserting the valve head, and attaching the actuator.

BRIEF DESCRIPTION OF THE DRAWINGS

Four embodiments of the invention are illustrated by way of example in FIGS. 1 to 4 respectively of the accompanying drawings, which are all cross-sectional views through the valves, showing identical conventional diaphragm actuators in elevation mounted on the first end of each valve housing.

DETAILED DESCRIPTION OF THE INVENTION

Figure 1:
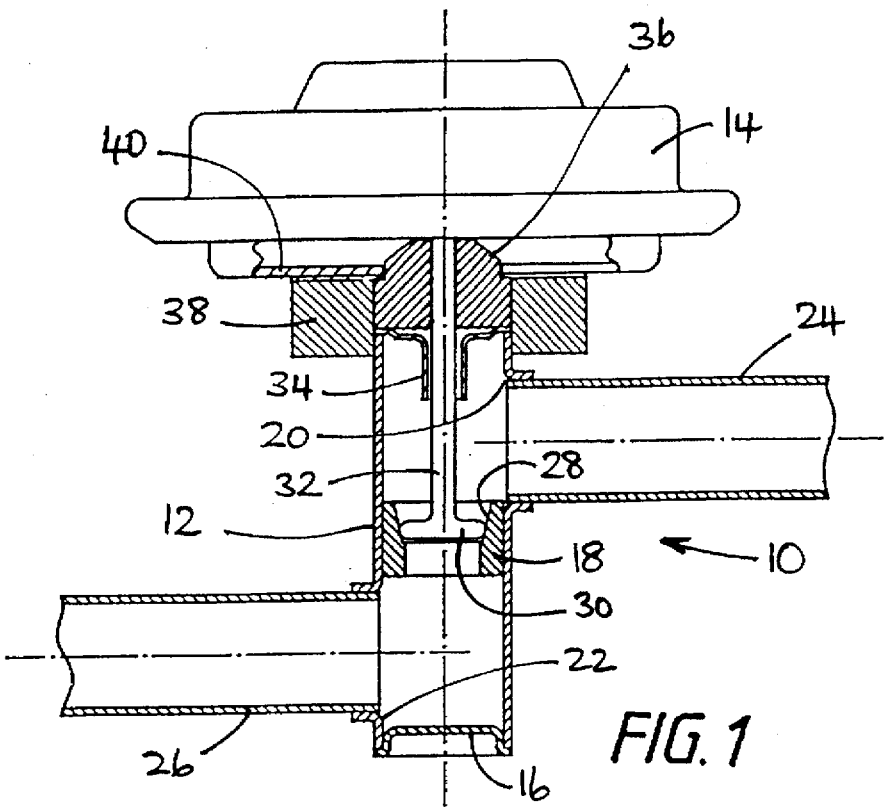

FIG. 1 shows a valve 10 comprising a short length of straight cylindrical tube 12 with an actuator 14 mounted on a first end thereof. The second end has been closed by a blanking cap 16. Midway between the tube ends is a stainless steel valve seat 18 which was inserted into the tube from one end, and was brazed in position while being held as an interference fit, Prior to this step, a lateral outlet aperture 20 was formed in the tube wall between the seat location and the first tube end, and an inlet aperture 22 was formed in the tube wall between the seat location and the second tube end. A length of EGR tubing 24 is connected to outlet aperture 30 for recirculating gases to the induction side of an engine, and a length of EGR, tubing 26 is connected to the inlet aperture 22 for recirculatiug gases from the exhaust side of the engine.

The valve seat 18 is a turned cylinder with a conically tapered axial through passage 28 which receives a valve head 30 integral with an operating rod 32. The operating rod extends axially of the housing tube 18 to the first end thereof, where it passes through a guide 34 and a bush 36 before connecting to the actuator 14. The conical inner surface of the valve seat forms the valve seat proper.

The tapering valve seat is wider towards the first end of the tube, facing the actuator 14. Accordingly, the actuator draws on the operating rod to lift the valve head from the seat to open the valve, and presses on the rod to close the valve. The valve head lies on the widening outlet side of the tapered valve seat.

A boss 38 is fitted around the first end of the housing and is tapped to allow the diaphragm actuator to be screwed in position over a sealing gasket 40. The valve guide 34 and guide bush 36 are held within the surrounding boss 38 between the actuator and the first end of the housing.

It will be appreciated that the angles and alignments of the attached EGR inlet and outlet tubing 26, 24 can be varied by altering the positioning and axial directions of the inlet and outlet apertures 22, 20 without substantially altering the valve in any other way. The valve assembly can be made of light and thin walled materials. The inserted valve seat however needs to be a structure of substance because of the erosion engendered by hot exhaust gases at this point and the valve design accommodates this requirement.

Figure 2:
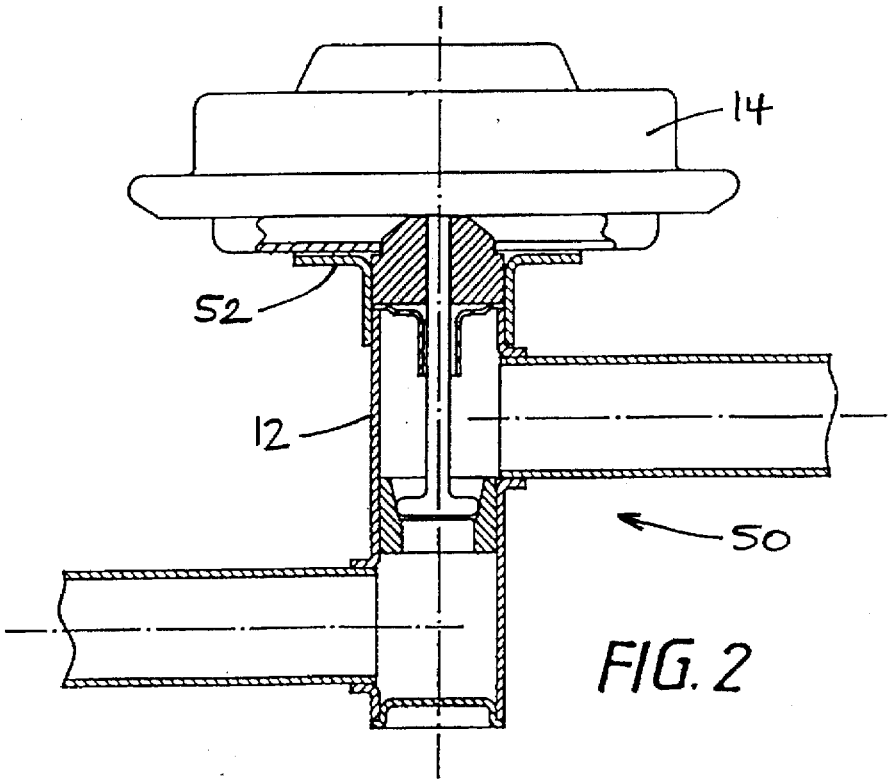

FIG. 2 shows a valve 50 that is identical with the valve 10 of FIG. 1 except in the provision for mounting the actuator 14 at the first end of the housing tube 12. In this case a flange ring 52 replaces the boss 38 of FIG. 1, to give a yet lighter construction.

Figure 3:
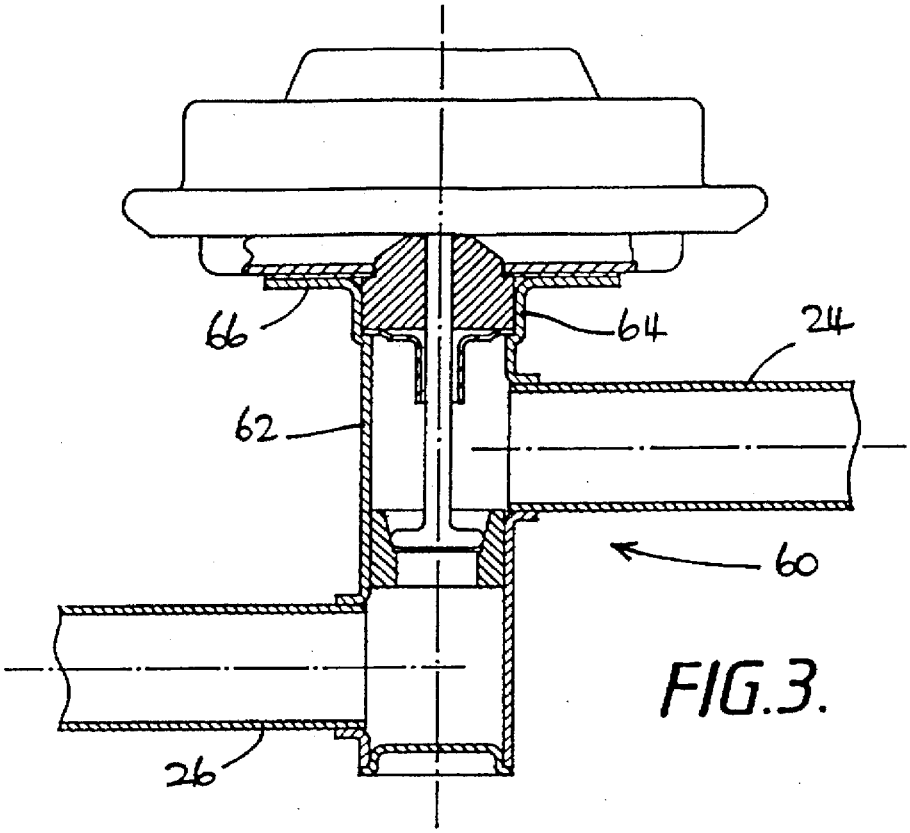

FIG. 3 shows a valve 60 that differs from the valve 50 of FIG. 2 only in that, in place of the two-part housing tube 12 and flange ring 52, a housing tube 62 is provided that is first belled out at 64 and then opened flat to form an integral flange 66 at its first end. Nevertheless, in the region of the tube 62 that forms the valve housing, it is straight and cylindrical (discounting the lateral connections to the inlet EGR tubing 26 and outlet EGR tubing 24).

In all of the valves 20, 50 and 60, the housing is short and just sufficient to accommodate the valve seat between the lateral inlet and outlet between a mounting for the actuator at the first end and a blanking plug at the second end. The valve is thus highly compact and the use of materials is kept to a minimum. The length of the valve housing tube, between the said mounting and plug at its two ends, is no more than about three times its diameter, and need not be more than four times the diameter of the attached EGR tubing.

Figure 4:
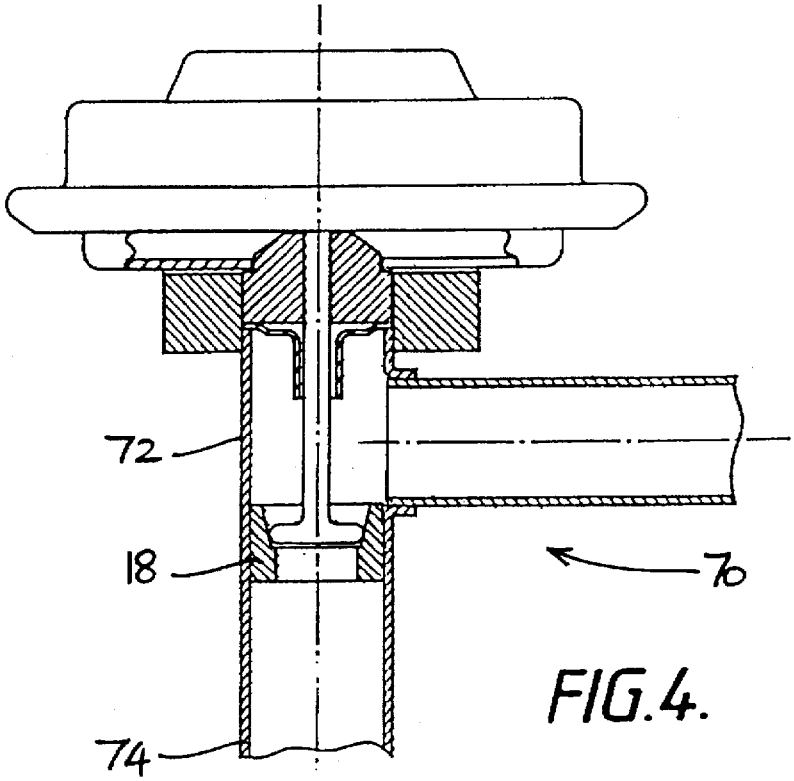

FIG. 4 shows a valve 70 that, between the first end of its housing tube 72 and the valve seat 18, is identical to valve 10 of FIG. 1. However, in this case there is no lateral EGR inlet aperture 22 in the tube wall. Instead, the housing tube is continuous with the EGR inlet tube 74, which of course can be bent to suit a particular engine compartment layout. The step of providing the inlet aperture has been eliminated, but with a possible cost in terms of design flexibility.

We claim:

1. An exhaust gas recirculation valve for an internal combustion engine comprising a tube having a wall defining a tubular valve housing, a valve seat in the housing having an axial through passage extending from an inlet side to an outlet side thereof, an actuator that is responsive to engine inlet manifold suction, a valve member connected to the actuator and adapted to cooperate with the valve seat to control the passage of exhaust gases through the valve in response to the actuator, a lateral gas outlet aperture in the tube wall on the outlet side of the gas seat and a length of exhaust gas recirculation tubing connected thereto for recirculating gases to the induction side of the engine, and a gas inlet to the housing comprising a lateral gas inlet aperture in the tube wall on the inlet side of the valve seat with a length of exhaust gas recirculation tubing connected thereto for receiving engine exhaust gases whose recirculation is to be controlled by the valve; wherein the valve housing is a straight length of cylindrical tube having a first end and a second end, and the valve seat is an insert that is received within the straight housing between the two ends and is closely engaged with a cylindrical inner wall surface thereof and wherein the second end of the cylindrical housing tube is blanked off by an end plug or cap, and the valve comprises, from the second end to the first end of the straight tube, a blanking piece, a lateral inlet, a valve head and a valve seat, a lateral outlet, and an actuator closing the first end.

2. An exhaust gas recirculation valve according to claim 1, wherein the valve seat is a cylindrical bush that is an interference fit in the tube and is fixed in place by crimping, welding or brazing.

3. An exhaust gas recirculation valve according to claim 2, wherein the actuator is mounted over the first end of the housing tube and is operatively connected to the valve member by a rod extending axially down the tube to a valve head adapted to engage the valve seat, and the valve seat comprises a conically tapered axial through passage which receives the valve head.

4. An exhaust gas recirculation valve according to claim 3 wherein the tapering valve seat is wider towards the actuator, so that the actuator draws the valve head from the seat to open the valve, and presses the valve head towards the seat to close the valve.

5. An exhaust gas recirculation valve according to claim 1, wherein the length of the valve housing tube between its two ends, is no more than about three times the tube diameter.

6. An exhaust gas recirculation valve according to claim 7 wherein the length of the valve housing tube, between its two ends, is not more than four times the diameter of the attached exhaust gas recirculation tubing.

* * * * *